US011117405B2

(12) United States Patent
Fukusaka

(10) Patent No.: US 11,117,405 B2
(45) Date of Patent: Sep. 14, 2021

(54) IMAGE FORMING SYSTEM

(71) Applicant: CANON KABUSHIKI KAISHA, Tokyo (JP)

(72) Inventor: Tetsuro Fukusaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/855,319

(22) Filed: Apr. 22, 2020

(65) Prior Publication Data

US 2020/0338915 A1 Oct. 29, 2020

(30) Foreign Application Priority Data

Apr. 26, 2019 (JP) ..... JP2019-086649

(51) Int. Cl.

| | |
|---|---|
| ***B41J 29/377*** | (2006.01) |
| ***B41J 2/14*** | (2006.01) |
| ***B41J 2/335*** | (2006.01) |
| *G03G 15/20* | (2006.01) |
| *B41J 11/00* | (2006.01) |

(52) U.S. Cl.

CPC ..... *B41J 29/377* (2013.01); *B41J 2/1408* (2013.01); *B41J 2/3358* (2013.01); *B41J 11/002* (2013.01); *B41J 11/007* (2013.01); *B41J 2202/08* (2013.01); *G03G 15/2017* (2013.01); *G03G 15/2021* (2013.01)

(58) Field of Classification Search

CPC ..... B41J 29/377; B41J 2/1408; B41J 2/3358; B41J 2202/08; B41J 11/002; B41J 11/007; G03G 15/2017; G03G 15/2021

See application file for complete search history.

(56) References Cited

U.S. PATENT DOCUMENTS

| | | | | |
|---|---|---|---|---|
| 9,827,797 | B1 * | 11/2017 | Boland | B41J 29/377 |
| 9,975,352 | B2 * | 5/2018 | Manabe | B41J 3/60 |
| 2014/0060782 | A1 * | 3/2014 | Ikeda | B41J 11/007 165/104.26 |

FOREIGN PATENT DOCUMENTS

JP 2006-003819 A 1/2006

* cited by examiner

*Primary Examiner* — Henok D Legesse
(74) *Attorney, Agent, or Firm* — Venable LLP

(57) ABSTRACT

An image forming system includes an image forming unit configured to form a toner image on a recording material; a fixing device configured to fix the toner image on the recording material on which the toner image is formed by the image forming unit; a first cooling unit capable of cooling the recording material passing through the fixing device; a second cooling unit capable of cooling the recording material passing through the first cooling unit; and a control unit configured to carry out control so that during execution of an image forming job, the image forming job is stopped when both the first cooling unit and the second cooling unit are out of order and is continued when only one of the first cooling unit and the second cooling unit is out of order.

7 Claims, 7 Drawing Sheets

IMAGE FORMING SYSTEM

FIELD OF THE INVENTION AND RELATED ART

The present invention relates to an image forming system, such as a printer, a copying machine, a facsimile machine or a multi-function machine, capable of forming an image by using an electrophotographic process.

In an image forming apparatus of an electrophotographic type, a toner image formed on a recording material such as paper is fixed on the recording material by being heated and pressed by a fixing device. For that reason, the recording material discharged from the fixing device is liable to increase in temperature when compared with the recording material before fixing. Then, when the recording material after the toner image is fixed is stacked in a high-temperature state, there is a liability that the recording materials stick to each other due to viscosity of toner and glossiness of the toner image becomes uneven. Therefore, in order to lower the temperature of the recording material after the fixing of the toner image, an image forming apparatus including a cooling device for cooling the recording material after the toner image fixing has been proposed (Japanese Laid-Open Patent Application (JP-A) 2006-003819). In the image forming apparatus disclosed in JP-A 2006-003819, one cooling device is provided in the image forming apparatus.

In recent years, image forming apparatuses have been required to have a multimedia compatibility and high productivity so as to be capable of accommodating recording materials of various kinds, such as plain paper, thick paper, roughed paper, uneven paper (embossed paper), and coated paper. For example, when the thick paper is compared with the plain paper, heat is conducted from a fixing roller to be heated to the recording material in accordance with a target temperature and thus a temperature of the fixing roller lowers, with the result that a fixing temperature when the toner image is fixed on the recording material lowers and therefore improper fixing is liable to occur. Even in the plain paper and the thick paper, in order to prevent the improper fixing to occur, the fixing temperature may only be required to be made high, but when the fixing temperature is increased, a temperature of the recording material after the toner image is fixed also becomes high. In that case, when only the single cooling device is used as the image forming apparatus disclosed in JP-A 2006-003819, it is difficult to sufficiently lower the recording material temperature. Therefore, it would be considered that the recording material is made coolable by using a plurality of cooling devices through connection of the image forming apparatus with an external cooling device as a peripheral machine, which extends a function of the image forming apparatus and which is capable of being additionally attached to the image forming apparatus, in order to further lower the recording material temperature in the form of an image forming system.

In a conventional constitution, it would be considered that when even the single cooling device of the plurality of cooling devices is out of order, an image forming job is stopped (so-called system down). However, when the image forming job is stopped even though there is a cooling device which is not out of order, down time occurs and operation efficiency of the image forming system can lower. Therefore, an image forming system in which an image forming job is continued without being stopped even when at least one of the cooling devices becomes out of order is desired, but such an image forming system has not yet been proposed.

SUMMARY OF THE INVENTION

The present invention has been achieved in view of the above-described problem, and a principal object of the present invention is to provide an image forming system capable of continuing an image forming job even when at least one of a plurality of cooling devices becomes out of order.

According to an aspect of the present invention, there is provided an image forming system comprising: an image forming unit configured to form a toner image on a recording material; a fixing device configured to fix the toner image on the recording material on which the toner image is formed by the image forming unit; a first cooling unit capable of cooling the recording material passed through the fixing device; a second cooling unit capable of cooling the recording material passed through the first cooling unit; and a control unit configured to carry out control so that during execution of an image forming job, the image forming job is stopped when both the first cooling unit and the second cooling unit are out of order and is continued when either one of the first cooling unit and the second cooling unit is out of order.

Further features of the present invention will become apparent from the following description of exemplary embodiments with reference to the attached drawings.

DESCRIPTION OF EMBODIMENTS

First Embodiment

Image Forming System

Figure 1:
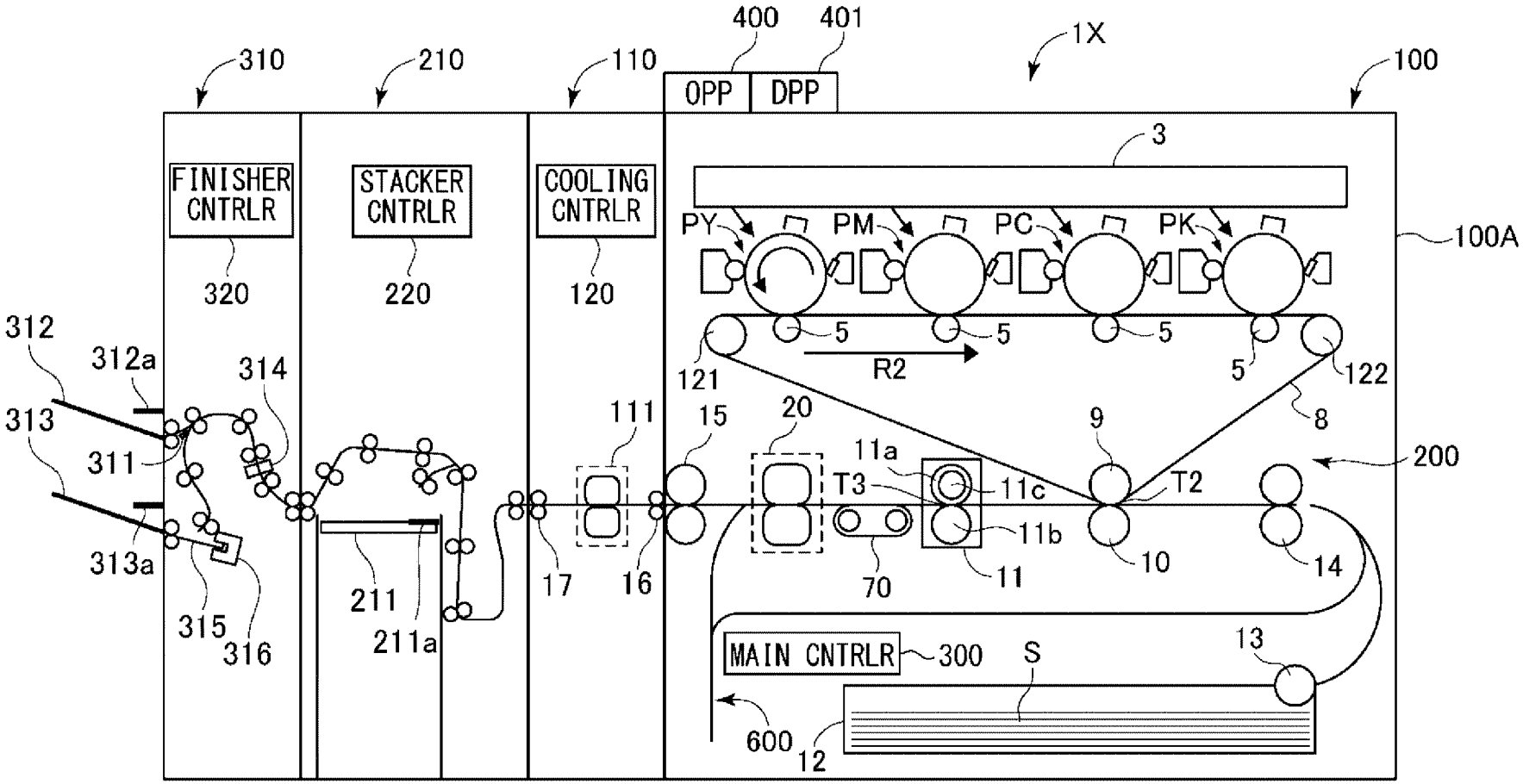
FIG. 1 is a schematic view showing a structure of an image forming system according to an embodiment of the present invention.

A general structure of an image forming system of this embodiment will be described with reference to FIGS. 1 to 3. An image forming system 1X shown in FIG. 1 includes an image forming apparatus 100, an external cooling unit 110, a stacker unit 210 and a finisher unit 310.

Image Forming Apparatus

The image forming apparatus 100 is an electrophotographic full-color printer of a tandem type. The image forming apparatus 100 includes image forming portions PY, PM, PC and PK for forming images of yellow, magenta, cyan and black, respectively. The image forming apparatus 100 forms and fixes a toner image on a recording material S in response to an image signal sent from an original reading device (not shown) connected to an apparatus main assembly 100A or from an external device such a personal computer communicatably connected to the apparatus main assembly 100A. As the recording material S, it is possible to use sheet materials of various kinds, such as sheets including plain paper, thick paper, roughened paper, uneven paper and coated paper; plastic films; and cloths. In the case of this embodiment, an image forming unit 200 for forming the toner image on the recording material S is constituted by the image forming portions PY to PK, primary transfer rollers 5, an intermediary transfer belt 8, an inner secondary transfer roller 9, an outer secondary transfer roller 10, and stretching rollers 121 and 122.

As shown in FIG. 1, the image forming portions PY, PM, PC and PK are juxtaposed along a movement direction of the intermediary transfer belt 8 in the apparatus main assembly 100A. The intermediary transfer belt 8 is constituted so as to be stretched by the plurality of the stretching rollers and to travel in an arrow R2 direction in the figure. The intermediary transfer belt 8 carries and feeds the toner image transferred from a photosensitive drum 1 (FIG. 2). At a position opposing, through the intermediary transfer belt 8, the inner secondary transfer roller 9 and stretching the intermediary transfer belt 8, the outer secondary transfer roller 10 is disposed, so that a secondary transfer portion T2 where the toner image on the intermediary transfer belt 8 is transferred onto the recording material S is formed. On a side downstream of the secondary transfer portion T2 with respect to a recording material feeding direction, a fixing device 11 is provided.

At a lower portion of the image forming apparatus 100, a cassette 12 in which recording materials S are accommodated is provided. The recording material S is fed from the cassette 12 toward a registration roller pair 14 by a feeding roller 13. Thereafter, the registration roller pair 14 is started to be rotated in synchronism with the toner image formed on the intermediary transfer belt 8, so that the recording material S is fed toward the secondary transfer portion T2. Incidentally, in this embodiment, only one cassette 12 is shown, but a plurality of cassettes 12 capable of accommodating the recording materials different in size and thickness may also be provided, and in that case, the recording material S is selectively fed from either one of the plurality of cassettes 12. Further, the recording material S is not limited to the recording material S accommodated in the cassette 12, but the recording material S stacked on a manual feeding portion (not shown) may also be fed.

The four image forming portions PY, PM, PC and PK included in the image forming apparatus 100 have the substantially same constitution except that development colors are different from each other. Accordingly, in this embodiment, as a representative, the image forming portion PK will be described, and other image forming portions will be omitted from description.

Figure 2:
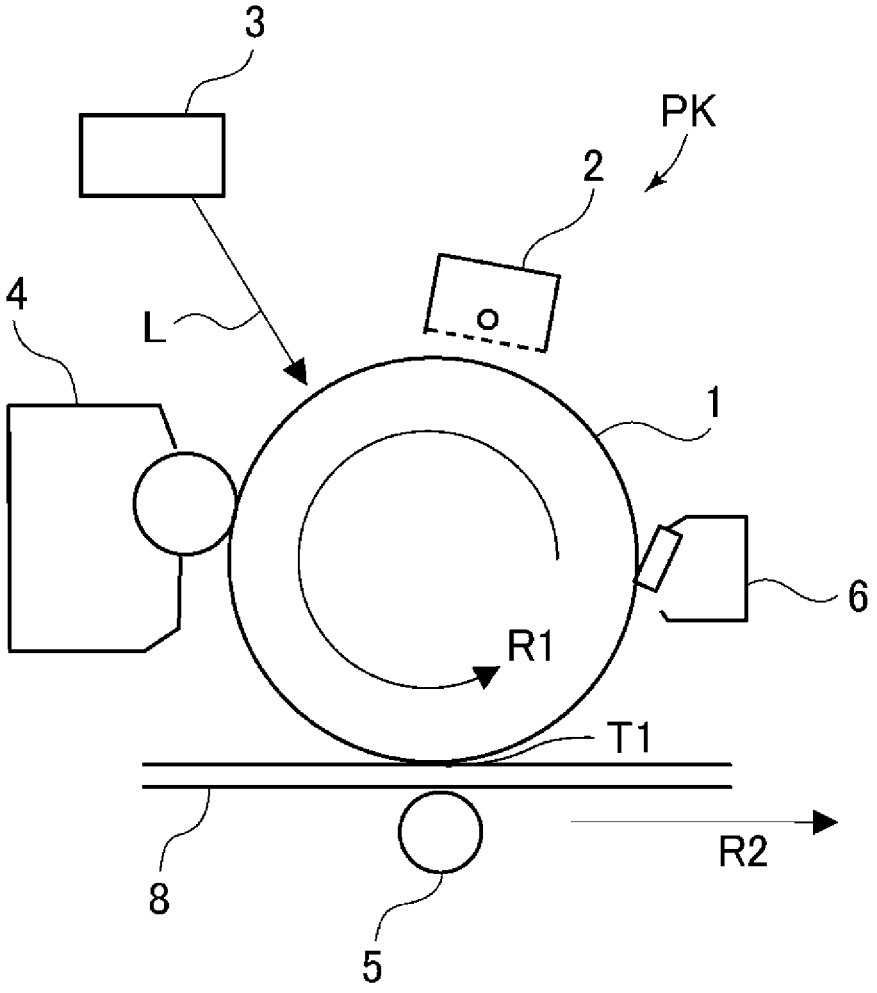
FIG. 2 is a schematic view showing an image forming portion.
Figure 3:
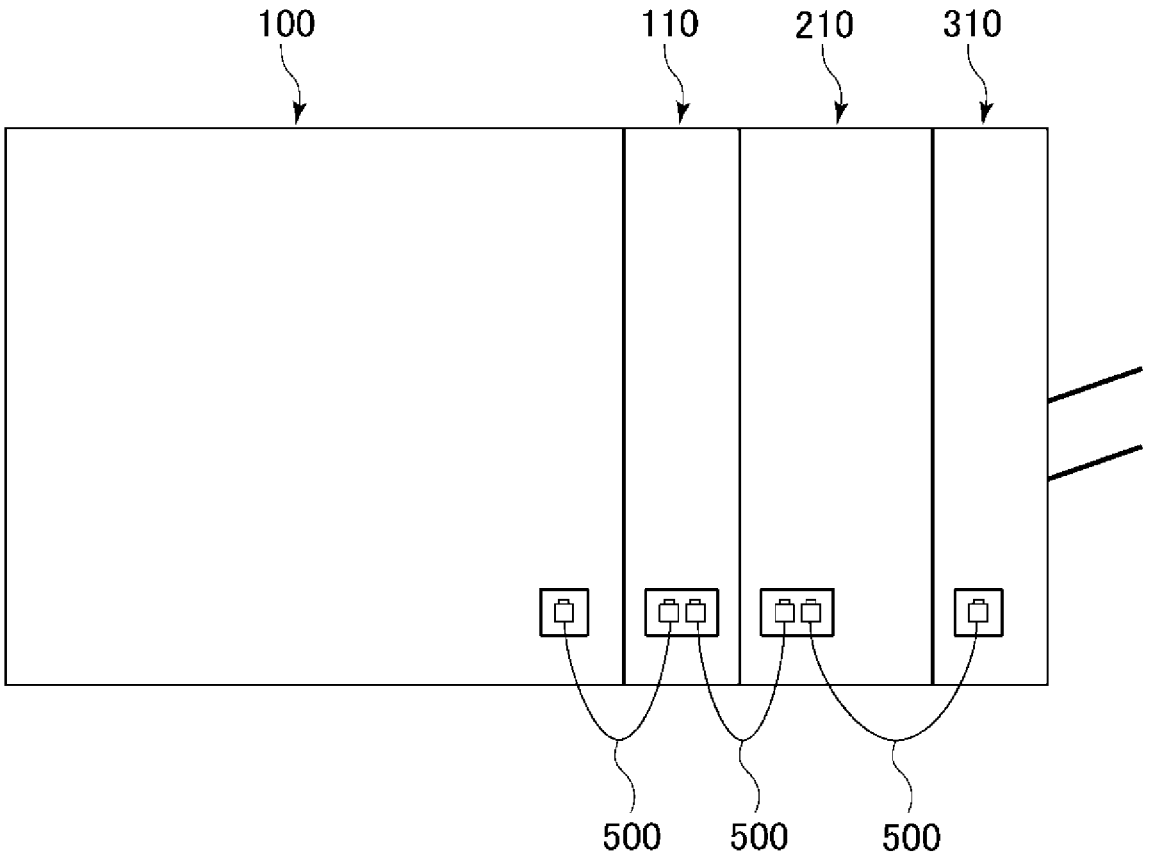
FIG. 3 is a schematic view showing a rear side of the image forming system.

As shown in FIG. 2, in the image forming portion PK, a cylindrical photosensitive drum 1 is provided as a photosensitive member. The photosensitive drum 1 is rotated in an arrow R1 direction at a predetermined process speed. At a periphery of the photosensitive drum 1, a charging device 2, an exposure device 3, a developing device 4, the primary transfer roller 5 and a cleaning device 6 are provided.

A process for forming a full-color image by the image forming apparatus 100 will be described. First, when an image forming operation is started, a surface of the rotating photosensitive drum 1 is electrically charged uniformly by the charging device 2. The charging device 2 is a corona charger or the like for charging the photosensitive drum 1 to a uniform negative dark-portion potential by irradiating the photosensitive drum 1 with charged particles using corona discharge, for example. Then, the photosensitive drum 1 is subjected to scanning exposure to laser light L which is emitted from the exposure device 3 and which corresponds to an image signal. By this, an electrostatic latent image depending on the image signal is formed on the surface of the photosensitive drum 1. The electrostatic latent image formed on the photosensitive drum 1 is visualized (developed) into a visible image by toner (developer) accommodated in the developing device 4.

The resultant toner image formed on the photosensitive drum 1 is primary-transferred onto the intermediary transfer belt 8 at a primary transfer portion T1 formed between the intermediary transfer belt 8 and the photosensitive drum 1 opposing the primary transfer roller 5. At this time, to the primary transfer roller 5, a primary transfer bias (voltage) is applied. After the primary transfer, toner remaining on the surface of the photosensitive drum 1 is removed by the cleaning device 6.

Returning to FIG. 1, such an operation is sequentially performed in the image forming portions PY, PM, PC and PK for yellow, magenta, cyan and black, respectively, so that four color toner images are superposed on the intermediary transfer belt 8. Thereafter, in synchronism with toner image forming timings, the recording material S accommodated in the cassette 12 is fed to the secondary transfer portion T2. Then, by applying a secondary transfer bias (voltage) to the outer secondary transfer roller 10, the toner images for a full-color image are collectively secondary-transferred onto the recording material S.

The recording material S on which the toner images are secondary-transferred is fed toward the fixing device 11. The fixing device 11 includes a fixing roller 11*a* as a first rotatable member provided rotatably and a pressing roller 11*b* as a second rotatable member rotating while being press-contacted to the fixing roller 11*a*. In a state in which the pressing roller 11*b* is press-contacted to the fixing roller 11*a*, the fixing roller 11*a* is rotated at a predetermined rotational speed (for example, 400 mm/sec) by an unshown driving motor. Inside the fixing roller 11*a*, a halogen heater 11*c* as a heating unit is provided, and the halogen heater is capable of heating the fixing roller 11*a*. By the halogen heater, a surface temperature of the fixing roller 11*a* is increased, so that the fixing device 11 is capable of heating the recording material S.

Figure 4:
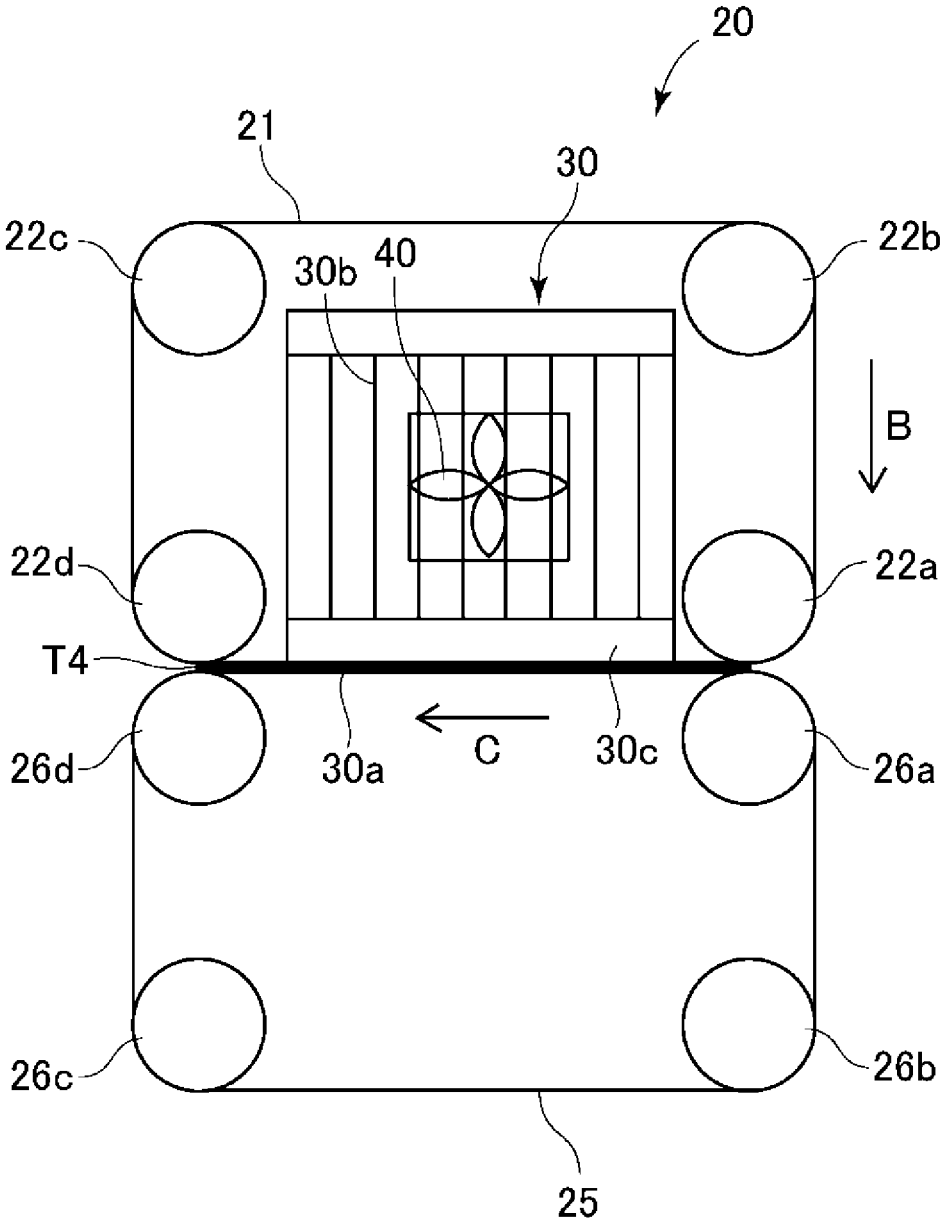
FIG. 4 is a schematic view showing a cooling device.

At a fixing nip T3 formed by the fixing roller 11*a* and the pressing roller 11*b*, the fixing device 11 nips and feeds the recording material S on which the full-color toner image is formed and thus heats and presses fed recording material S, so that the full-color toner image is fixed on the recording material S. That is, the toners of the full-color toner image formed on the recording material S are melted and mixed by heating and pressing, and are fixed as a full-color image on the recording material S. Thus, a series of operations of the image forming process is ended. Then, the recording material S on which the toner image is fixed is fed toward a recording material cooling device 20 by a feeding device 70. The recording material cooling device 20 as a first cooling unit is capable of cooling the recording material S and is capable of lowering a temperature of the recording material S. The recording material cooling device 20 will be described later (FIG. 4).

In the case of this embodiment, the image forming apparatus 100 is capable of performing double-side printing. In the case of single-side printing, the recording material S on which the toner image is fixed is discharged by a discharge roller pair 15 to an outside of the apparatus main assembly 100A through a discharge opening formed in the apparatus main assembly 100A. In the case of the double-side printing, the recording material S on which the toner image is fixed is fed toward a reverse feeding passage 600 for the double-side printing. In the reverse feeding passage 600, the recording material S is reversed, so that a front surface and a back surface of the recording material S are flipped. The reversed recording material S is fed toward the registration roller pair 14, and then is fed by the registration roller pair 14 toward the secondary transfer portion T2 in a state in which the back surface side thereof where printing has not been carried out faces the intermediary transfer belt 8 side. At the secondary transfer portion T2, the toner images for a full-color image formed on the intermediary transfer belt 8 are collectively secondary-transferred on the recording material S (the back-surface side). Thereafter, the recording material S is subjected to toner image fixing by the fixing device 11 and cooling by the recording material cooling device 20, and the recording material S after the cooling is discharged through the discharge opening (not shown) to the outside of the apparatus main assembly 100A. Incidentally, in the image forming apparatus 100, a feeding speed at which the recording material S is fed is variable.

With the image forming apparatus 100, the external cooling unit 110, the stacker unit 210 and the finisher unit 310 are connected so as to be capable of delivering the recording material S in the named order from an upstream side with respect to the recording material feeding direction. The external cooling unit 110, the stacker unit 210, and the finisher unit 310 are constituted, as peripheral machines (optional units) which can be additionally attached for extending functions of the image forming apparatus, so as to be connectable to the image forming apparatus 100.

The image forming apparatus 100 includes the recording material cooling device 20 in the apparatus main assembly 100A, but in order to ensure higher cooling power (performance), the external cooling unit 110 for further cooling the recording material S cooled by the recording material cooling device 20 is connected to the image forming apparatus 100. The external cooling unit 110 as a second cooling unit includes a cooling device 111 capable of cooling the recording material S. The cooling device 111 will be described later (FIG. 4).

The recording material S cooled by the external cooling unit 110 is fed to the stacker unit 210. As shown in FIG. 1, the stacker unit 210 feeds the recording material S, sent from the external cooling unit 110, into an accommodating box 211 therein or to the finisher unit 310 by switching the feeding passage. The recording material S fed into the accommodating box 211 is gradually accumulated in the accommodating box 211 in a stacked form. The accommodating box 211 is provided with a stacker (stacking) sensor 211*a* for detecting that the number of the stacked recording materials S reaches a predetermined number of sheets. The stacker sensor 211*a* is capable of detecting a stacking height or a stacking weight of the recording materials S stacked in the accommodating box 211. Incidentally, a feeding speed at which the recording material S is fed in the external cooling unit 110 is variable.

The recording material S fed from the stacker unit 210 to the finisher unit 310 is subjected to punching (punch processing) in which the recording material S is punched by the finisher unit 310 or to stapling (processing) in which a plurality of recording materials S are stapled by the finisher unit 310. In the case where the finisher unit 310 performs the punching, the recording material S is once stopped at a punching portion 314 and then is subjected to the punching. Thereafter, the feeding passage is switched by a discharge designation switching portion 311, and the punched recording material S is discharged onto an upper sheet discharge tray 312. On the other hand, in the case where the finisher unit 310 performs the stapling, the recording material S is fed to a stapling tray 315 by switching the feeding passage by the discharge designation switching portion 311. Then, when a predetermined number of recording materials S are stacked on the stapling tray 315, the stapling is performed by a stapler 316. Thereafter, a bundle of the stapled recording materials S is discharged on a lower sheet discharge tray 313.

The upper sheet discharge tray 312 and the lower sheet discharge tray 313 are provided with tray stacking sensors 312*a* and 313*a*, respectively, for detecting that the number of the recording materials S stacked on the associated sheet discharge tray reaches a predetermined number of sheets. The tray stacking sensor 312*a* is capable of detecting a stacking height or a stacking weight of the recording materials S stacked on the upper sheet discharge tray 312, and the tray stacking sensor 313*a* is capable of detecting a stacking height or a stacking weight of the recording material S stacked on the lower sheet discharge tray 313.

As described above, the image forming apparatus 100, the external cooling unit 110, the stacker unit 210 and the finisher unit 310 are connected between adjacent devices so as to be capable of delivering the recording material S therebetween. Further, as shown in FIG. 3, the image forming apparatus 100, the external cooling unit 110, the stacker unit 210 and the finisher unit 310 are connected between adjacent devices through a communication cable 500 capable of serial communication or parallel communication so as to be capable of sending and receiving data therebetween. In the case of this embodiment, the adjacent devices are connected via the communication cable 500 so as to be communicable with each other, and thus the image forming apparatus 100 is capable of monitoring an operation status including a failure (out-of-order) state while controlling the external cooling unit 110, the stacker unit 210 and the finisher unit 310.

Recording Material Cooling Device

Next, the recording material cooling device 20 provided in the apparatus main assembly 100A and the cooling device 111 provided in the external cooling unit 110 will be described with reference to FIG. 4. However, the cooling device 111 may have the same structure as the recording material cooling device 20, and therefore, in this embodiment, the recording material cooling device 20 will be described as an example.

As shown in FIG. 4, the recording material cooling device 20 includes an endless first belt 21 and an endless second belt 25 for nipping and feeding the recording material S in cooperation with the first belt 21. Further, the recording material cooling device 20 includes a heat sink 30 for cooling at least one of the first belt 21 and the second belt 25.

The first belt 21 is extended around first belt stretching rollers 22*a* to 22*d*, and at least one of the first belt stretching rollers is rotated by an unshown driving portion. By this, the first belt 21 is moved and circulated in an arrow B direction in FIG. 4. On the other hand, the second belt 25 is extended around second belt stretching rollers 26*a* to 26*d* and contacts the first belt 21. Therefore, the second belt 25 is moved and circulated by the first belt 21. Incidentally, in this embodiment, the first belt 21 is driven, and the second belt 25 is driven by the first belt 21, but to the contrary, the second belt 25 may be driven and the first belt 21 may also be driven by the second belt 25. Or, both, the first belt 21 and the second belt 25 may also be driven.

The recording material S on which the toner image is fixed is nipped between the first belt 21 and the second belt 25 and is fed in a feeding direction (arrow C direction in the figure) in accordance with circulatory movement of these belts. During the feeding, the recording material S passes through a cooling nip T4 formed by contact between the first belt 21 and the second belt 25. In the case of this embodiment, the first belt 21 is cooled by the heat sink 30. The heat sink 30 is disposed so as to contact an inner surface of the first belt 21, at a position where the cooling nip T4 is formed, in order to efficiently cool the recording material S. The recording material S is cooled via the first belt 21 when the recording material S passes through the cooling nip T4, so that even when the toner on the recording material S is in a melted state before the recording material S contacts the first belt 21, the toner is capable of being fixed on the recording material S by being cooled. Thus, the recording material S is cooled in the cooling nip T4 formed by the first belt 21 and the second belt 25, so that the recording material S can be cooled efficiently in a short feeding passage.

The heat sink 30 is radiator (dissipater) plate formed of metal such as aluminum. The heat sink 30 includes a heat receiving portion 30*a* for taking heat from the first belt 21 in contact with the first belt 21, a heat radiating (dissipating) portion 30*b* for radiating (dissipating) heat, and a fin base 30*c* for transferring the heat from the heat receiving portion 30*a* to the heat radiating portion 30*b*. The heat radiating portion 30*b* is formed with many radiating fins in order to promote efficient radiation by ensuring a contact area to the air. Further, in order to forcedly cool the heat sink 30 itself, a cooling fan 40 sending the air toward the heat sink 30 (specifically the heat radiating portion 30*b*) is provided. The cooling fan 40 is driven by an unshown motor rotated in accordance with supply of a current by an unshown power source, and an air flow rate thereof is set at, for example, "2 $m^3$/min" during normal operation.

Incidentally, the heat sink 30 is contacted to the first belt 21 so as to cool the first belt 21 but is not limited thereto, and may also be contacted to the second belt 25 so as to cool the second belt 25. Or, a single heat sink 30 is contacted to each of the first belt 21 and the second belt 25, so that both the belts may also be cooled. However, the heat sink 30 may preferably be contacted to the first belt 21 or the second belt 25, which contacts the recording material S on a side where the toner image is fixed by the fixing device 11, immediately before the recording material S is discharged through a discharge opening. Further, a cooling means is not limited to the heat sink 30, but the first belt 21 and/or the second belt 25 may also be cooled by using a belt cooling fan for sending the air toward the belt or by a water cooling unit in which a pipe or the like in which cooled liquid is circulated is contacted to the belt or by the like means.

Controller

Figure 5:
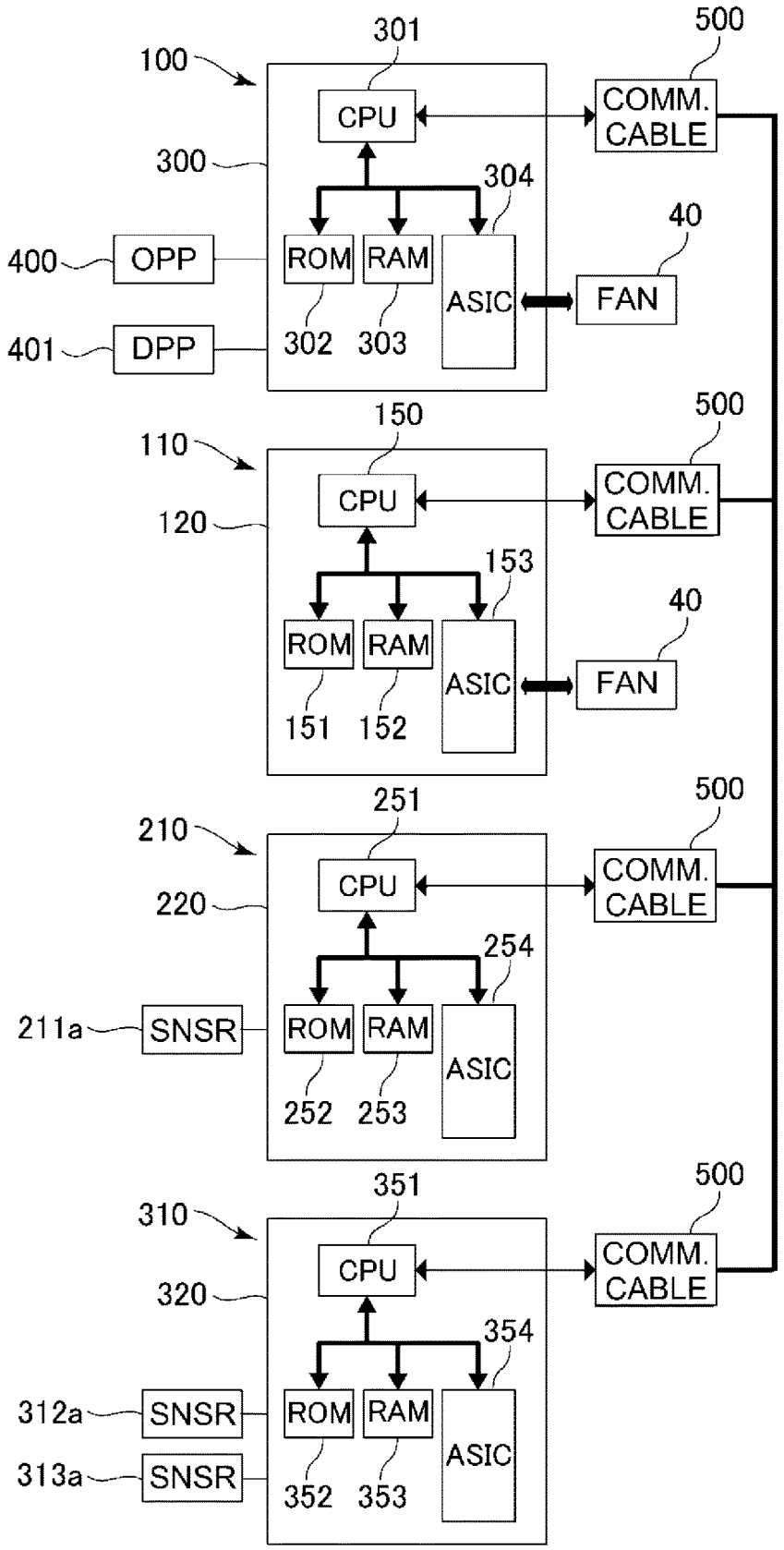
FIG. 5 is a control block diagram illustrating a constitution of a controller in the image forming system.

Next, a constitution of a controller in the image forming system 1X of this embodiment will be described using FIG. 5 while making reference to FIG. 1. As shown in FIG. 5, the image forming system 1X of this embodiment includes, in addition to a main controller 300, a cooling controller 120, a stacker controller 220 and a finisher controller 320, each of which is connected to the main controller 300 via a communication cable 500. The main controller 300 is capable of controlling an entire operation of the image forming system 1X. In accordance with an operation instruction from the main controller 300, the cooling controller 120 causes the external cooling unit 110 to operate, the stacker controller 220 causes the stacker unit 210 to operate, and the finisher controller 320 causes the finisher unit 310 to operate. Further, while the main controller 300 controls the image forming apparatus 100, the external cooling unit 110, the stacker unit 210 and the finisher unit 310, the main controller 300 monitors operation statuses thereof including failure (out of order) states thereof.

The main controller 300, the cooling controller 120, the stacker controller 220 and the finisher controller 320 which are described above may have the same constitution. For example, each of the controllers includes a CPU (central processing unit), a ROM (read only memory), a RAM (random access memory) and the like. Further, each of the controllers includes an ASIC (application specific integrated circuit).

The main controller 300 principally controls the image forming apparatus 100, but in the case of this embodiment, by carrying out various pieces of control of the external cooling unit 110, the stacker unit 210, and the finisher unit 310, an image forming function of the image forming system 1X is realized.

As shown in FIG. 5, the main controller 300 includes the CPU 301, the ROM 302, the RAM 303 and the ASIC 304. In the ROM 302 and the RAM 303, various programs for an image forming job and a process during cooling failure (FIG. 6 or FIG. 7) described later, or various data such as a target temperature of the fixing device 11 for fixing the toner image on the recording material S or a feeding speed of the recording material S are stored. Incidentally, the target temperature is a temperature of the halogen heater 11*c* for maintaining the fixing nip of the fixing device 11 at a predetermined temperature. Further, the target temperature is also a surface temperature of the fixing roller 11*a* heated by the halogen heater 11. The target temperature may be stored for each of the kinds (or thickness, basis weight or the like) of the recording material S. The ASIC 304 is connected to respective loads, such as power (voltage) sources and motors, for operating the image forming portions PY to PK and the cooling fan 40 (FIG. 4) of the recording material cooling device 20 and the like, for example, and not only controls operations of these portions or members by an operation instruction from the CPU 301, but also monitors operation statuses thereof.

The image forming apparatus 100 of this embodiment includes an operating portion 400 and a display portion 401 (FIG. 1), and the operating portion 400 and the display portion 401 are connected to the main controller 300. The operating portion 400 is, for example, an operating panel, an external terminal or the like for receiving execution instructions of the various programs, various data input, and the like by a user. In this embodiment, the user is capable of providing an instruction to start the image forming system by using the operating portion 400. In the case where the instruction to start the image forming job is provided from the operating portion 400, on the basis of image data inputted from the operating portion 400, the CPU 301 executes an image forming process (program) stored in the ROM 302.

The display portion 401 is for example, a liquid crystal screen or an external display or the like capable of displaying failure (out-of-order) display of the recording material cooling device 20 and the cooling device 11 and menus presenting various programs executable by the user. Incidentally, the main controller 300 may also cause the display portion 401 to display virtual operators imitating physical operators, so that by utilizing the virtual operators, execution start operations of the various programs and input operations of various data by the user can be received by the display portion 401.

Incidentally, a communication interface to which the communication cable 500 is connected includes a plurality of signal paths such as a serial signal line and a parallel signal line. The main controller 300 is capable of actuating the external cooling unit 110, the stacker unit 210 and the finisher unit 310 by sending a paper source remote signal through the parallel signal line. Further, the main controller 300 is capable of monitoring the external cooling unit 110, the stacker unit 210 and the finisher unit 310. The main controller 300 is capable of sending and receiving serial data, such as operation instructions, through the serial signal line between the external cooling unit 110, the stacker unit 210 and the finisher unit 310.

The cooling controller 120 includes a CPU 150, a ROM 151, a RAM 152, and an ASIC 153. The CPU 150 controls the external cooling unit 110 on the basis of a control program stored in the ROM 151. The ASIC 153 is connected to respective loads such as a motor and a power source for operating the cooling fan 40 (FIG. 4) of the external cooling unit 110, and controls operations thereof by instructions from the CPU 150. At this time, when the motor and the power source for operating the cooling fan 40 are out of order (failure), the CPU 150 determines the failure and sends a failure (out-of-order) signal to the main controller 300 through the communication cable 500.

The stacker controller 220 includes a CPU 251, a ROM 252, a RAM 253, and an ASIC 254. The CPU 251 controls the stacker unit 210 on the basis of a control program stored in the RAM 252. The ASIC 254 is connected to respective loads such as a motor and a power source for moving an accommodating box 211 upward and downward, and controls operations thereof by instructions from the CPU 251. To the stacker controller 220, a stacker (stacking) sensor 211*a* is connected, and on the basis of a detection result of the stacker sensor 211*a*, the stacker controller 220 is capable of specifying the number of stacked sheets of the recording materials stacked in the accommodating box 211. The specified number of stacked sheets is sent to the main controller 300 via the communication cable 500. In the case of this embodiment, in the RAM 303 of the main controller 300, the number of an upper limit of the recording materials S capable of being stacked in the accommodating box is stored. In the case where the number of stacked sheets of the recording materials S stacked in the accommodating box 211 exceeds the number of the upper limit, the main controller 300 causes the display portion 401 to display an "excessive stacking (state)" of the accommodating box 211.

The finisher controller 320 includes a CPU 351, a ROM 352, a RAM 353, and an ASIC 354. The CPU 351 controls the finisher unit 310 on the basis of a control program stored in the RAM 352. The ASIC 354 is connected to respective loads such as the punching portion 314 and the stapler 316, and controls operations thereof by instructions from the CPU 351. To the finisher controller 320, tray stacking sensors 312*a* and 313*a* are connected, and on the basis of a detection result of the tray stacking sensors 312*a* and 313*a*, the finisher controller 320 is capable of specifying the number of stacked sheets of the recording materials stacked in the upper sheet discharge tray 312 and the lower sheet discharge tray 313. The specified number of stacked sheets is sent to the main controller 300 via the communication cable 500. In the case of this embodiment, in the RAM 303 of the main controller 300, the number of an upper limit of the recording materials S capable of being stacked in each of the upper sheet discharge tray 312 and the lower sheet discharge tray 313 is stored. In the case where the number of stacked sheets of the recording materials S stacked in each of the upper sheet discharge tray 312 and the lower sheet discharge tray 313 exceeds the number of the upper limit, the main controller 300 causes the display portion 401 to display an "excessive stacking (state)" of each of the upper sheet discharge tray 312 and the lower sheet discharge tray 313.

Processing During Cooling Failure

Next, processing during cooling failure in this embodiment will be described using FIG. 6 while making reference to FIGS. 1 and 5. The processing during the cooling failure in this embodiment is started by the main controller 300 in response to a start of an image forming job.

Figure 6:
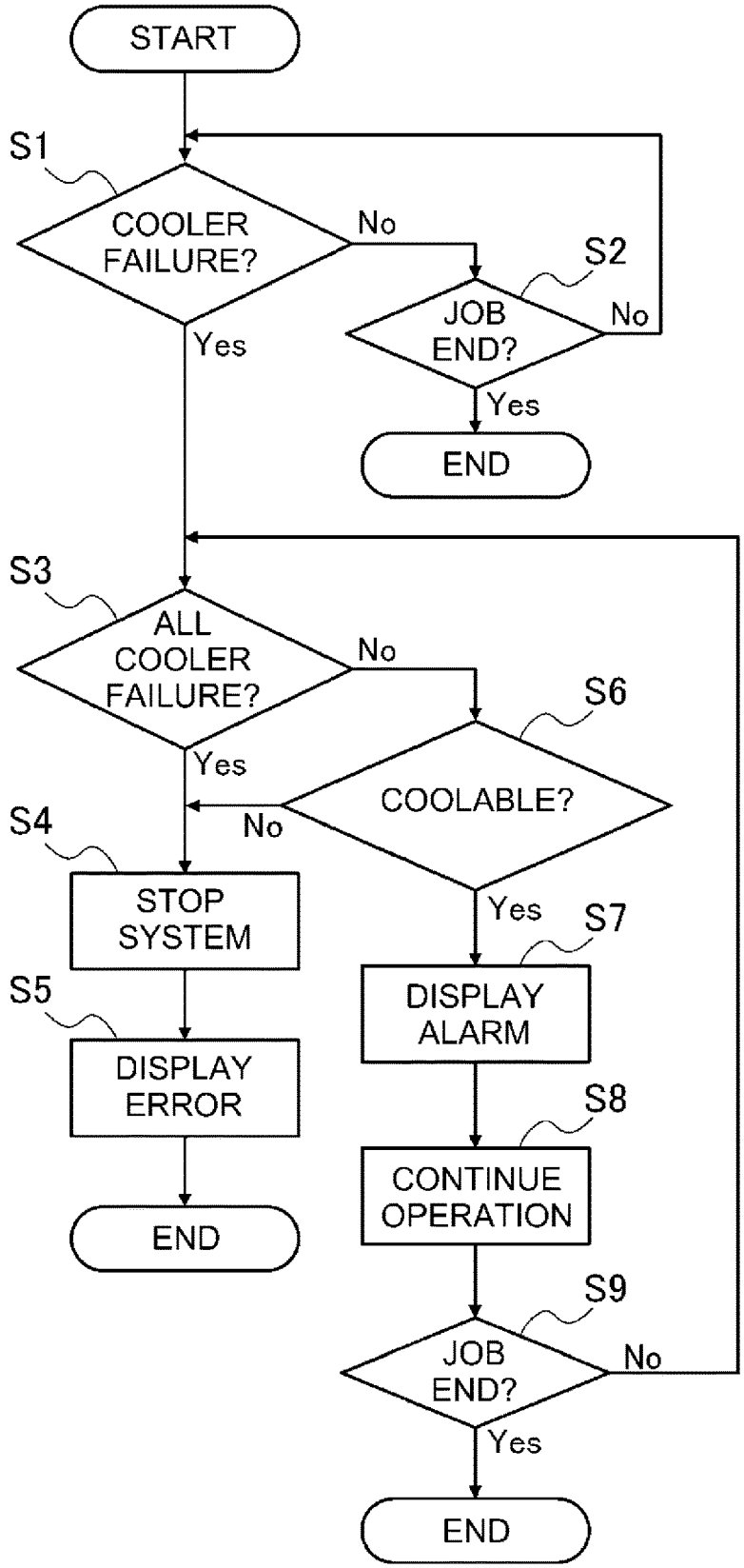
FIG. 6 is a flowchart showing a process during cooling failure in a first embodiment.

As shown in FIG. 6, the main controller 300 monitors operation statuses of the recording material cooling device 20 in the image forming apparatus 100 and the cooling device 111 in the external cooling unit 110 and discriminates whether or not failure of these cooling devices is detected during execution of the image forming job (S1). The failure of the recording material cooling device 20 and the cooling device 111 referred to herein means the case where, for example, the cooling fan 40 (FIG. 4) undergoes improper operation due to failure of the power source or the motor and cannot realize a desired cooling function (including the case of non-operation). In the case where the main controller 300 does not detect the failure of the recording material cooling device 20 and the cooling device 111, i.e., in the case where both the cooling devices operate normally (No of S1), the main controller 300 discriminates whether or not the image forming job is ended (S2). In the case where the image forming job is ended (Yes of S2), the main controller 300 ends the processing during the cooling failure. In the case where the image forming job is not ended (No of S2), the main controller 300 continues the image forming job and the processing returns to the step S1.

In the case where the main controller 300 detects the failure of the recording material cooling device 20 or the cooling device 111 (Yes of S1), the main controller 300 discriminates whether or not both (i.e., all) the recording material cooling device 20 and the cooling device 111 are out of order (S3). In the case where both the cooling devices are out of order (Yes of S3), the main controller 300 forcedly stops operations of the external cooling unit 110, the stacker unit 210 and the finisher unit 310 (S4). When the image forming system 1X is forcedly stopped, for example, even though the images are not formed on the recording materials S in the number of sheets inputted from the operating portion 400, i.e., even when the image forming job is before the end thereof, the image forming job 313 is forcedly stopped. Then, the main controller 300 causes the display portion 401 to display error display (message) to the effect that both the recording material cooling device 20 and the cooling device 111 are out of order (S5), and then ends the processing during the cooling failure.

In the case where either one (i.e., only one) of the recording material cooling device 20 and the cooling device 111, not both the cooling devices, is out of order (No of S3), the main controller 300 discriminates whether or not the recording material S is coolable by the one of the recording material cooling device 20 and the cooling device 111 which is not out of order (S6). In the case of this embodiment, discrimination as to whether or not the recording material S is coolable by only the cooling device which is not out of order is made depending on execution of an operation of the image forming job in either one of fixing modes shown in the following Table 1.

TABLE 1

| Fixing mode | TP*1 (° C.) | NONCD*2 |
|---|---|---|
| First | 180-200 | 2 |
| Second | <180 | 1 |

*1"TP" is a target temperature.
*2"NONCD" is the number of necessary cooling devices.

The first fixing mode is mode in which the target temperature is 180-200° C. and is used, for example, in the case where the image is formed on thick paper or in the case where a solid image is formed. In this embodiment, in the case of the operation in the first mode, the number of the cooling devices necessary to lower the temperature of the recording material S after the toner image fixing is two. That is, by using only a single cooling device, cooling for sufficiently lowering the temperature of the recording material S cannot be carried out. On the other hand, the second fixing mode is a mode in which the target temperature is less than 180° C., and is used, for example, in the case where the image is formed on plain paper. In this embodiment, in the case of the operation in the second mode, the number of the cooling devices necessary to lower the temperature of the recording material S after the toner image fixing may only be required to be one.

In the case where the image forming job during execution is performed by the operation in the second mode, on the basis of the Table 1 described above, the main controller 300 discriminates that the recording material S is coolable only by the single cooling device which is not out of order (Yes of S6). In other words, when the target temperature is lower than a predetermined temperature (180° C. in this embodiment), the main controller 300 detects that the recording material S is coolable only by the single cooling device. In such a case, the main controller 300 causes the display portion 401 to not only display the one of the recording material cooling device 20 and the cooling device 111 which is out of order, but also produce an alarm display such that the image forming job is continuing while performing cooling of the recording material S only by the single cooling device which is not out of order (S7). Then, the main controller 300 continues the operation of the image forming system (S8). That is, even in the case where one of the recording material cooling device 20 and the cooling device 111 which is out of order causes improper operation, the image forming job is continued. Then, the main controller 300 discriminates whether or not the image forming job is ended (S9). In the case where the image forming job is ended (Yes of S9), the main controller 300 ends the processing during the cooling failure. In the case where the image forming job is not ended (No of S9), the processing returns to the process of the step S3, and the main controller 300 repetitively performs the processes of the step S3 and the steps S7 to S9.

On the other hand, in the case where the image forming job is the operation in the first fixing mode, on the basis of the Table 1, the main controller 300 discriminates that the recording material S is not coolable only by the single cooling device which is not out of order (No of S6). In other words, when the target temperature is the predetermined temperature or more, the main controller discriminates that the recording material S is not coolable only by the single cooling device which is not out of order. In that case, the processing goes to the process of the step S4, and the main controller 300 forcedly stops the image forming system 1X even when the image forming job is before the end thereof (S4). That is, the image forming job is stopped. Then, the main controller 300 causes the display portion 401 to display the one of the recording material cooling device 20 and the cooling device 111 which is out of order (S5), and then ends the processing during the cooling failure.

As described above, in this embodiment, in the case of the constitution in which the temperature of the recording material S after the toner image is fixed thereon is lowered by using the recording material cooling device 20 and the external cooling unit 110, even when either one of the device and the unit is out of order, the operation of the image forming system 1X can be continued. At that time, in the case where the recording material S is sufficiently coolable, the recording material S is cooled by using the cooling device or unit which is not out of order. Then, even in the cooling using either one of the recording material cooling device 20 and the external cooling unit 110, the temperature of the recording material S after the toner image fixing can be lowered to a temperature in a degree such that sticking of the toner due to viscosity of the toner does not readily occur. That is, the temperature of the recording material S can be made not more than a melting temperature of the toner. Thus, even when either one of the recording material cooling device 20 and the external cooling unit 110 is out of order, the user is capable of continuing the image forming job without concern for the sticking of the recording material S, with the result that the user is capable of efficiently using the image forming system.

Second Embodiment

Figure 7:
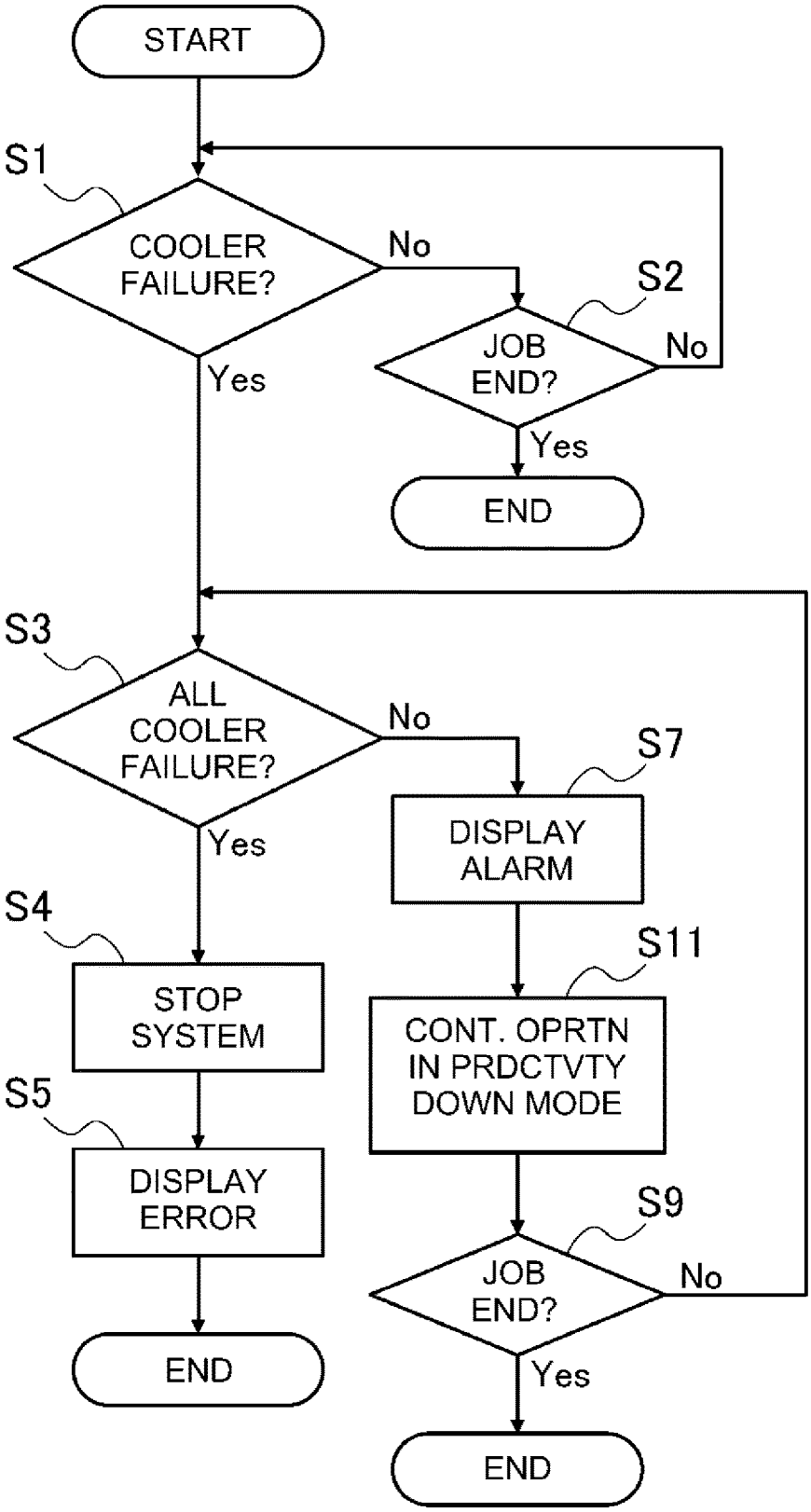
FIG. 7 is a flowchart showing a process during cooling failure in a second embodiment.

Next, processing during cooling failure in a second embodiment will be described using FIG. 7 while making reference to FIGS. 1 and 5. However, in the processing during the cooling failure in this embodiment shown in FIG. 7, the same processes as those in the processing during the cooling failure in the first embodiment (FIG. 6) are represented by the same reference symbols and will be briefly described or omitted from description. Processes of steps S1 to S5 are the same as those in the above-described first embodiment.

In the case where either one of the recording material cooling device 20 and the cooling device 111 is out of order (No of S3), the main controller 300 causes the display portion 401 to produce an alarm display indicating out-of-order one of the recording material cooling device 20 and the cooling device 111 (S7). At that time, the main controller 300 causes the display portion 401 to display also a message to the effect that the image forming job is continued in an operation in a "productivity down mode" in which productivity of the image forming system 1X is reduced. In the case of this embodiment, the main controller 300 causes the image forming system 1X to continue the operation in the "productivity down mode" in which the recording material S is sufficiently coolable with only the single cooling device being not out of order and which is shown in Table 2 below (S11). That is, even though the out-of-order one of the recording material cooling device 20 and the cooling device 111 is not in operation, the image forming job is continued. Then, the main controller 300 discriminates whether or not the image forming job is ended (S9). In the case where the image forming job is ended (Yes of S9), the main controller 300 ends the processing during cooling failure. In the case where the image forming job is not ended (No of S9), the processing returns to the process of the step S3, and the main controller 300 causes the image forming system 1X to continue the image forming job.

TABLE 2

| Mode | NOUCD*1 | FS*2 | PRDCTVTY*3 (A4) |
|---|---|---|---|
| NM*4 | 2 | 450 mm/sec | 100 ppm |
| PDM*5 | 1 | 300 mm/sec | 70 ppm |

*1"NOUCD" is the number of usable cooling devices.
*2"FS" is a feeding speed.
*3"PRDCTVTY" is productivity.
*4"NM" is a normal mode.
*5"PDM" is the productivity down mode.

The "productivity down mode" (S11) will be described using an example. During an image forming job in an operation in the normal mode, the feeding speed of the recording material S is set at 450 mm/sec so that productivity of image formation on an A4-size recording material S is 100 sheets per minute (100 ppm). In that case, a time required for the recording material S to pass through the recording material cooling device 20 is short, so that there is a liability that the recording material S is not sufficiently cooled only by the recording material cooling device 20. Therefore, in the operation in the normal mode, the recording material S is cooled by using the external cooling unit 110 in addition to the recording material cooling device 20. On the other hand, when either one of the recording material cooling device 20 and the external cooling unit 110 is out of order, the recording material S cannot be sufficiently cooled only by the single cooling device which is not out of order. Therefore, in this embodiment, the image forming system 1X is operated in order to continue the image forming job in the operation in the "productivity down mode" reduced in productivity as described above (S11). For example, the feeding speed of the recording material S is set at 300 mm/sec which is slower than the feeding speed (450 mm/sec) before the cooling failure, so that the productivity is lowered to 70 sheets per minute. Thus, the feeding speed of the recording material S is made slow, and a passing time of the recording material S through either one of the recording material cooling device 20 and the external cooling unit 110, which is out of order, is made long, so that a time in which the recording material S can be cooled is ensured. Further, during feeding of the recording material S through a feeding passage, heat can be dissipated from the recording material S, so that the temperature of the recording material S can be lowered.

As described above, in this embodiment, the operation of the image forming system 1X is continued even when either one of the recording material cooling device 20 and the external cooling unit 110 is out of order, but at that time, the feeding speed of the recording material S is made slower than that during normal operation (normal mode). By making the feeding speed of the recording material S slow, until the recording material S after the toner image is fixed thereon reaches the stacker unit 210 and the finisher unit 310, the temperature of the recording material S can be lowered to a temperature to the extent that sticking of the recording material S does not readily occur. That is, even when either one of the recording material cooling device 20 and the external cooling unit 110 goes out of order, the user is capable of continuing the image forming job without concern for the sticking or the like of the recording material S. Accordingly, also in this embodiment, an effect similar to the effect of the above-described first embodiment such that the image forming system 1X can be used efficiently is obtained.

Incidentally, in the second embodiment, when the feeding speed of the recording material S is made slow as described above, in addition thereto, the target temperature (Table 1) may also be lowered. Then, the temperature of the recording material S is easily lowered to the temperature to the extent that the sticking of the recording material S is not liable to occur.

Other Embodiments

Incidentally, in the above-described embodiments, the constitution in which the single recording material cooling device 20 is provided in the image forming apparatus 100 and the single external cooling unit 110 (first external cooling unit) as the peripheral machine is connected to the image forming apparatus 100 was described as an example, but the present invention is not limited thereto. For example, the above-described embodiments are applicable even when a constitution in which a plurality of external cooling units (first and second external cooling units) 110 are connected to the image forming apparatus 100 without providing the single recording material cooling device 20 in the image forming apparatus 100 is employed. Or, the above-described embodiments are applicable even when a plurality of recording material cooling devices are provided in the image forming apparatus 100 and the external cooling unit 110 is not connected to the image forming apparatus 100 is employed. That is, the plurality of the cooling devices for cooling the recording material S may only be required to be provided along the feeding direction of the recording material S so that the recording material S successively passes through these cooling devices, and any arrangement of the cooling devices may be employed even though the cooling devices are disposed in the image forming apparatus 100 or are connected as the external cooling units 110 to the image forming apparatus 100. However, it is preferable that when the plurality of cooling devices can be connected as the external cooling units 110 to the image forming apparatus 100, the user is capable of easily adjusting cooling power (performance) of the recording material S with respect to the already-existing image forming apparatus 100 by the number of the external cooling units connected to the image forming apparatus 100.

Incidentally, the "connection" of the external cooling unit(s) 110 to the image forming apparatus 100 not only includes the constitution in which the external cooling unit(s) 110 is connected to the image forming apparatus 100 immediately behind a frame of the image forming apparatus 100 as shown in FIG. 1, but also includes the following constitution. For example, the "connection" also includes a constitution in which between the image forming apparatus 100 and the external cooling unit 110, another connecting unit connecting the image forming apparatus 100 and the external cooling unit 110 exists.

According to the present invention, even in the case where either one of the first cooling unit and the second cooling unit goes out of order, continuation of the image forming job can be easily realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-086649 filed on Apr. 26, 2019, which is hereby incorporated by reference herein in its entirety.

What is claimed is:

1. An image forming system comprising:

an image forming unit configured to form a toner image on a recording material;

a fixing device configured to fix the toner image on the recording material on which the toner image is formed by said image forming unit;

a first cooling unit capable of cooling the recording material passed through said fixing device;

a second cooling unit capable of cooling the recording material passed through said first cooling unit; and a control unit configured to carry out control so that during execution of an image forming job, the image forming job is stopped when both said first cooling unit and said second cooling unit are out of order and is continued when only one of said first cooling unit and said second cooling unit is out of order.

2. The image forming system according to claim 1, wherein said fixing device includes a first rotatable member, a second rotatable member configured to feed the recording material in cooperation with said first rotatable member, and a heating unit configured to heat said first rotatable member, and wherein in a case that only one of said first cooling unit and said second cooling unit is out of order, said control unit continues the image forming job when a temperature of said first rotatable member is lower than a predetermined temperature and stops the image forming job when the temperature of said first rotatable member is the predetermined temperature or higher.

3. The image forming system according to claim 2, wherein in the case that only one of said first cooling unit and said second cooling unit is out of order, said control unit makes the predetermined temperature lower than a temperature in a case that both said first cooling unit and said second cooling unit are not out of order.

4. The image forming system according to claim 1, wherein said control unit makes a feeding speed of the recording material, to be passed through said first cooling unit and said second cooling unit, slower in a case that only one of said first cooling unit and said second cooling unit is out of order than in a case that both said first cooling unit and said second cooling unit are out of order.

5. The image forming system according to claim 1, further comprising a display portion, wherein when both said first cooling unit and said second cooling unit are out of order, said control unit causes said display unit to display both said first cooling unit and said second cooling unit which are out of order, and wherein when only one of said first cooling unit and said second cooling unit is out of order, said control unit causes said display portion to display said cooling unit which is out of order.

6. The image forming system according to claim 1, further comprising a main assembly including said image forming unit and said fixing device, wherein said first cooling unit is a first external cooling device connected to said main assembly, and wherein said second cooling unit is a second external cooling device connected to said first external cooling device.

7. The image forming system according to claim 1, further comprising a main assembly including said image forming unit, said fixing device and said first cooling unit, wherein said second cooling unit is an external cooling device connected to said main assembly.

* * * * *